US006386362B1

(12) United States Patent
Cheng

(10) Patent No.: US 6,386,362 B1
(45) Date of Patent: May 14, 2002

(54) BASE SEAT OF GOLF BAG

(76) Inventor: Te Pin Cheng, No. 304, Tu-Shin Rd., Taichung City (TW)

( * ) Notice: Subject to any disclaimer, the term of this patent is extended or adjusted under 35 U.S.C. 154(b) by 0 days.

(21) Appl. No.: 09/709,453

(22) Filed: Nov. 13, 2000

(51) Int. Cl.[7] ..... A63B 55/00; A63B 55/04

(52) U.S. Cl. ..... 206/315.3; 206/315.7; 206/315.8; 248/96

(58) Field of Search ..... 206/315.7, 315.6, 206/315.3, 315.8; 248/96; 220/839; 229/189

(56) References Cited

U.S. PATENT DOCUMENTS 3,840,172 A * 10/1974 Zimmermann ..... 229/189
4,834,235 A 5/1989 Solheinm et al.
5,799,786 A * 9/1998 Beck et al. ..... 206/315.7
5,857,567 A 1/1999 Cheng
5,860,550 A * 1/1999 Miller et al. ..... 220/839 X
5,901,845 A * 5/1999 Cheng ..... 206/315.7
6,010,101 A * 1/2000 Stein et al. ..... 206/315.7 X
6,062,383 A * 5/2000 Han ..... 206/315.7

* cited by examiner

*Primary Examiner*—Lee Young
*Assistant Examiner*—Tri M. Mai
(74) *Attorney, Agent, or Firm*—Troxell Law Office PLLC

(57) ABSTRACT

A base seat of a golf bag includes a front section, a rear section and a pivot section bridged between the front and rear sections. The front and rear sections together each define a receiving room having an opening facing upward. The base seat can be bent about a predetermined portion of the pivot section. The base seat is part of a golf bag which includes a cylindrical bag body, an annular frame, several support rods and a support leg set. When the golf bag with the base seat is positioned upright, the lower sides of the front and rear sections are planely placed on the ground. By way of the weight of the golf clubs placed in the receiving rooms of the base seat, the golf bag can be stably rested on the ground. When a user tilts the bag body, by way of the pivot section, the rear section of the base seat is moved upward, while the front section remains in contact with the ground. The front section and the support leg set of the golf bag together support the golf bag in a tilted state.

6 Claims, 8 Drawing Sheets

BASE SEAT OF GOLF BAG

BACKGROUND OF THE INVENTION

The present invention relates to a component of a golf bag, and more particularly to a base seat of a golf bag. The base seat defines a bendable receiving room for receiving golf clubs.

U.S. Pat. No. 4,834,235 discloses a golf bag which can stand in a tilted state for a user to conveniently take out and place in golf clubs. The bag body of the golf bag is flexible. When downward pressing the bag body, the upper ends of a V-shaped resilient rod pivotally disposed on one side of the base seat are forcedly stretched outward. At this time, two support legs pivotally connected with the upper end of the bag body are driven to stretch outward. Under such circumstance, the bag body can stand in a tilted state without moving the base seat.

The above golf bag has a shortcoming in use that the support rods for supporting the bag body upright must be swingable, whereby they can be tilted together with the bag body. Accordingly, the golf bag can be hardly sufficiently supported and thus the golf bag often has a tortured appearance and tends to fall down.

U.S. Pat. No. 5,857,567 discloses a golf bag in which a swingable driving board is disposed under the base seat of the golf bag. The driving board serves to drive the lower end of a V-shaped resilient rod so as to indirectly force two support legs on two sides of the bag body to stretch outward. Accordingly, the golf bag can be supported by the support legs to stand in a tilted state.

Such golf bag has two shortcomings as follows: First, the lower edge of the base seat must be formed with an oblique cut within which the driving board is moved. Accordingly, when the bag body stands upright, the base seat contacts with the ground by a too small area so that the golf bag tends to fall down. Second, the driving board is disposed under the base seat and will contact with the ground for a long period. Therefore, the driving board is very likely to be affected by earth and dust. As a result, it often takes place that the driving board cannot be smoothly swung or the V-shaped rod can be hardly easily collected to attach to the lateral side of the bag body. A soft sheet material can be disposed around the driving board and the periphery of the base seat to more or less improve the above situation. However, the dust or mud will still infiltrate into the pivot section between the driving board and the lower edge of the base seat.

SUMMARY OF THE INVENTION

It is therefore a primary object of the present invention to provide a base seat of a golf bag. The base seat enables the golf bag to more stably stand on the ground upright.

It is a further object of the present invention to provide the above base seat of the golf bag. The base seat has a bendable section, whereby the base seat and the support legs of the golf bag can cooperatively support the golf bag to stand in a tilted state.

According to the above objects, the base seat of golf bag of the present invention includes: a front section having a first receiving room formed with an open end directed to upper side and an open end directed to rear side; a rear section having a second receiving room formed with an open end directed to upper side and an open end directed to front side; and a pivot section disposed between predetermined portions of the front and rear sections, whereby the first and second receiving rooms are connected to form a larger receiving room. The front and rear sections can be swung about a predetermined portion of the pivot section within a predetermined range. When the golf bag with the base seat is positioned upright, the lower sides of the front and rear sections are planely placed on the ground. By means of the weight of the golf clubs placed in the receiving room of the golf bag, the golf bag can be stably rested on the ground. When a user pushes the bag body and makes it tilted, by means of the pivot section, the rear section is upward swung, while the front section remains to contact with the ground. The front section and a pair of support legs of the golf bag together support the golf bag to stand in a tilted state as a tripod structure.

The present invention can be best understood through the following description and accompanying drawings wherein:

DETAILED DESCRIPTION OF THE PREFERRED EMBODIMENTS

Figure 1:
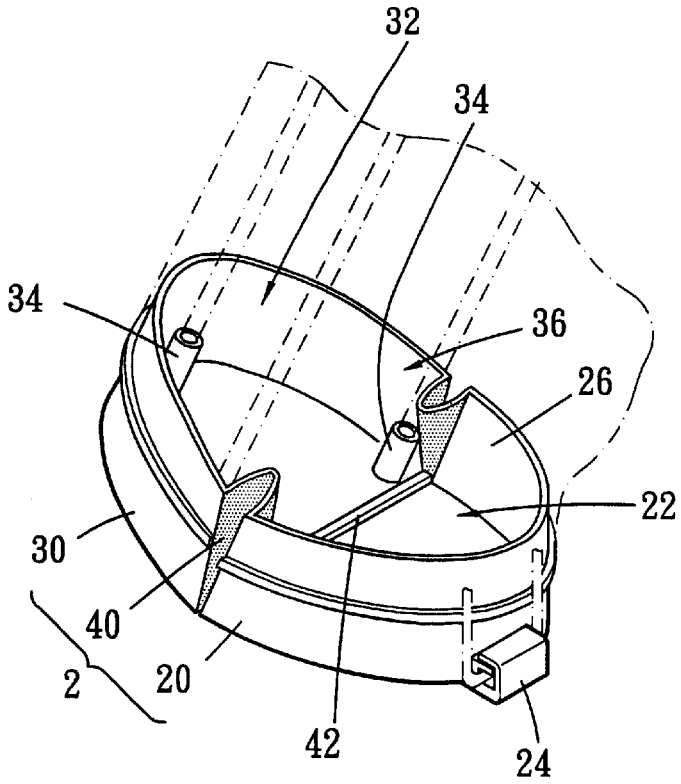
FIG. 1 is a perspective view of a first embodiment of the present invention.

Please refer to FIGS. 1 to 4. The base seat 2 of the present invention is positioned on the bottom of a golf bag 1. The golf bag 1 includes three support rods 12 fixed on the base seat 2, an annular frame 14 disposed at upper ends of the support rods 12, a support leg set 16 pivotally disposed on outer rim of the annular frame 14 and a cylindrical flexible bag body 18 disposed between the base seat 2 and the annular frame 14.

Three sleeve-like first fixing members 34 are arranged on the base seat 2. The lower ends of the support rods 12 are inserted in the first fixing members 34. The annular frame 14 has three second fixing members (not shown). The upper ends of the support rods 12 are inserted in the second fixing members. The upper and lower ends of the bag body 18 are respectively fitted on the annular frame 14 and the base seat 2. The support leg set 16 has a seat body 60 fixed on outer rim of the annular frame 14, a pair of support legs 62 the upper ends of which are pivotally connected with the seat body 60 and a V-shaped resilient member 64 the upper ends of which are respectively pivotally connected with the support legs 62. The lower end of the V-shaped resilient member 64 is pivotally disposed on the base seat 2.

The base seat 2 has a front section 20, a rear section 30 and a pivot section 40 connected between the front and rear sections 20, 30.

The front section 20 has a first receiving room 22 formed with an open portion directed to upper rear side. A reverse hook-shaped connecting member 24 is disposed on outer side of front end of the first receiving room 22. The lower end of the V-shaped resilient member 64 is latched in the connecting member 24.

The rear section 30 has a second receiving room 32 formed with an open portion directed to upper front side. The first fixing members 34 project from the inner periphery of the second receiving room 32 at intervals.

The pivot section 40 is made by injection molding. The periphery of the pivot section 40 is bridged between the edges of the lateral side and bottom face of the adjacent open portions of the front and rear sections 20, 30 so as to connect the first and second receiving rooms 22, 32. The pivot section 40 is further formed with a rib 42 slightly projecting from inner bottom face of the base seat 2. The pivot section 40 is made of well flexible plastic or rubber material, whereby the front and rear sections 20, 30 can be swung about the pivot section 40 by a certain amplitude.

When the golf bag 1 equipped with the base seat 2 is positioned upright, the front and rear sections 20, 30 are planely placed on the ground and the first and second receiving rooms 22, 32 respectively bear the weight of the golf clubs (not shown) placed in the golf bag 1. Under such circumstance, the golf bag 1 can be stably rested on the ground in an upright state. In addition, the support rods 12 serve to support the annular frame 14 to keep a smooth appearance of the bag body 18.

When a user depresses the front end of the golf bag 1 with the base seat 2 or forward pushes the annular frame 14, the golf bag 1 is forcedly tilted forward. After tilted, the front section 20 of the golf bag 1 remains to horizontally rest on the ground. The rear section 30 and the support rods 12 are swung upward about the bottom of the pivot section 40 by a certain angle so that the base seat 2 is bent. At this time, the portion of the bag body 18 corresponding to the rear side of the golf bag 1 is still supported by the support rods 12 and remains smooth. However, the portion of the bag body 18 corresponding to the front side of the golf bag 1 is slightly crimped. The front end of the annular frame 14 is slightly lowered and the distance of the front end of the annular frame 14 and the connecting member 24 is shortened. Accordingly, through the V-shaped resilient member 64, the two support legs 62 are forcedly stretched outward. The lower ends of the support legs 62 and the front section 20 cooperatively enable the golf bag 1 to stably rest on the ground in a tilted state.

Figure 5:
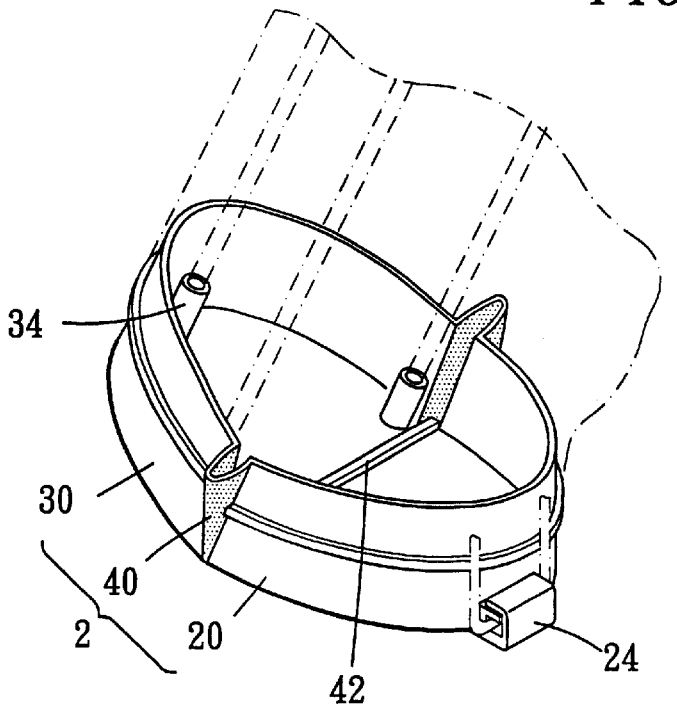
FIG. 5 is a perspective view of a second embodiment of the present invention.
Figure 2:
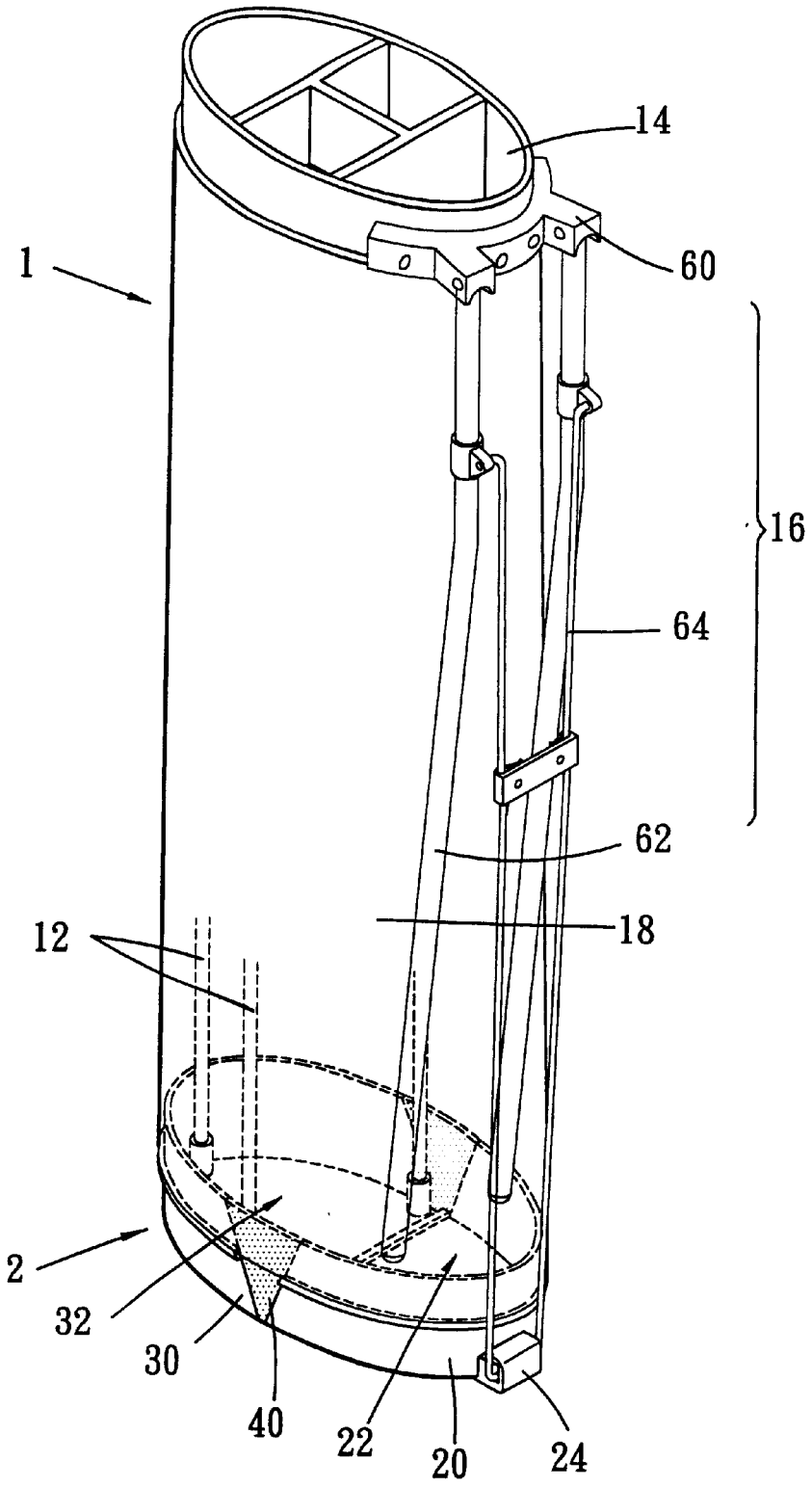
FIG. 2 is a perspective view showing the use of the first embodiment of the present invention.
Figure 3:
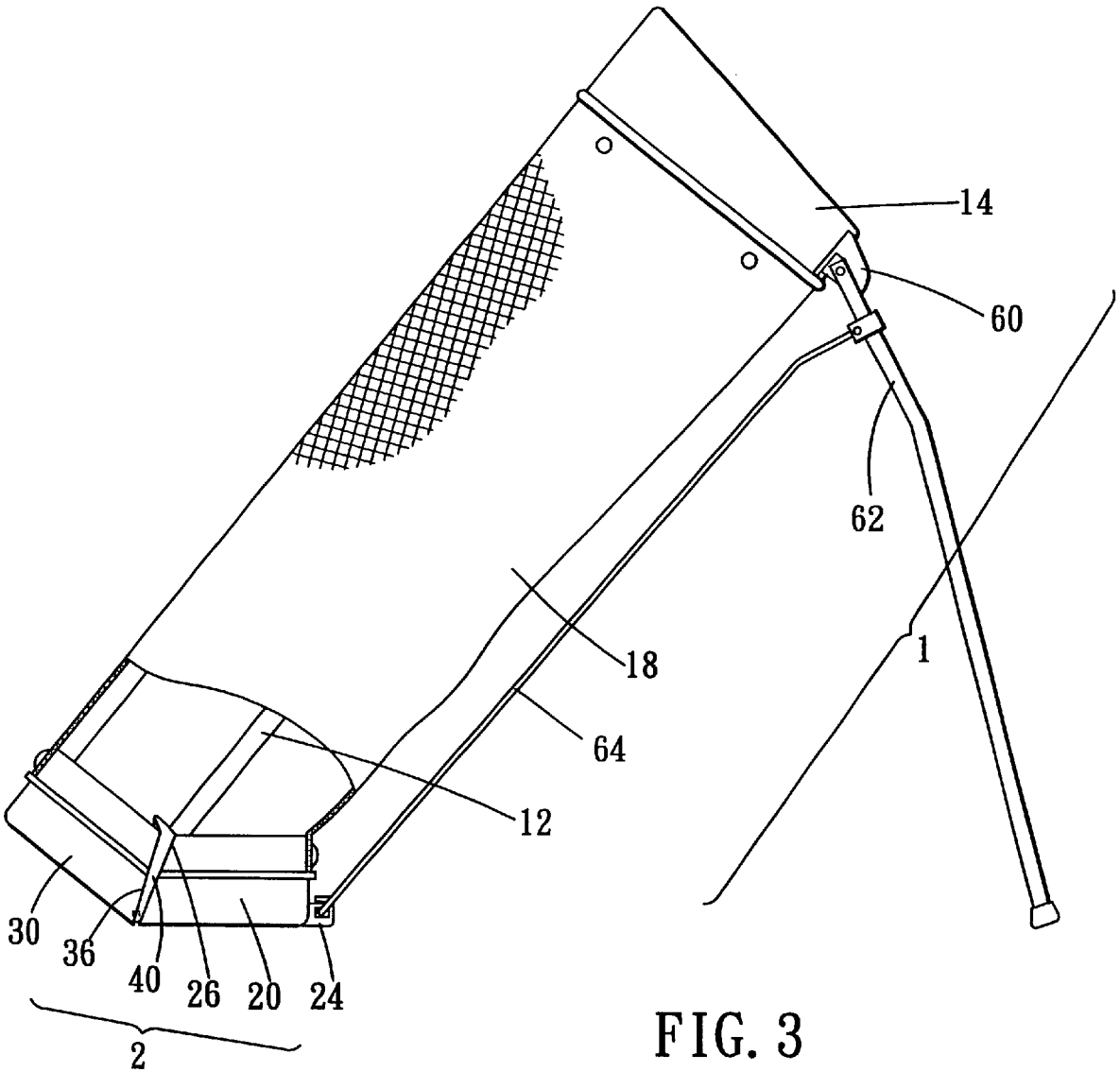
FIG. 3 is a side view showing the use of the first embodiment of the present invention.
Figure 4:
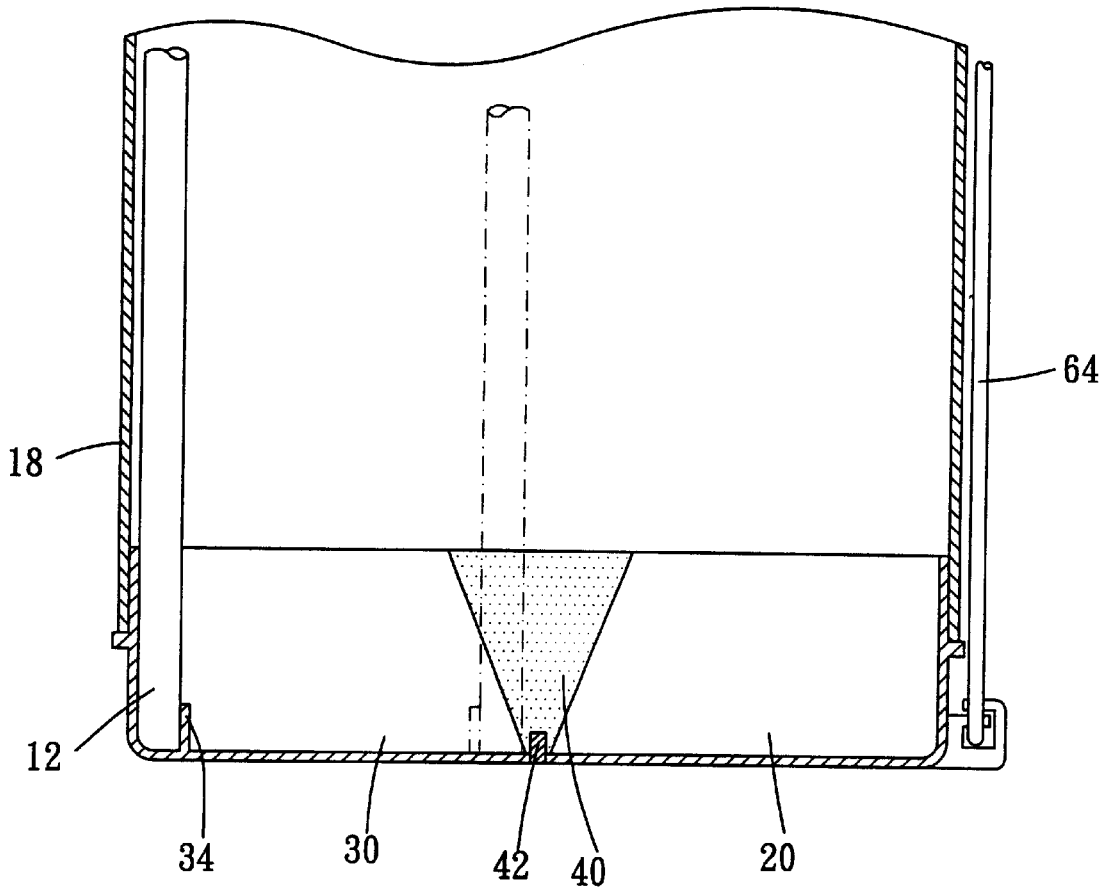
FIG. 4 is a sectional view showing the use of the first embodiment of the present invention.

The pivot section 40 of the present invention has a rib 42 with thicker thickness. Therefore, when the front section 20 and the rear section 30 are bent to each other, they are not subject to torsion. Two sides of the pivot section 40 are thinner so that when compressed, the two sides of the pivot section 40 can be slightly inward bent. As shown in FIG. 5, in the case that the thickness of the rib 42 is not so large, the lateral side of the pivot section 40 also may be bent outward when compressed.

In this embodiment, the edge portions 26, 36 of the opposite open ends of the front and rear sections 20, 30 are inclined from the bottom. Therefore, when the front and rear sections 20, 30 are planely positioned, the edge portions 26, 36 will define a V-shaped notch. When the front and rear sections 20, 30 are bent, the notch provides a space for the edge portions 26, 36 to get close to each other.

Figure 6:
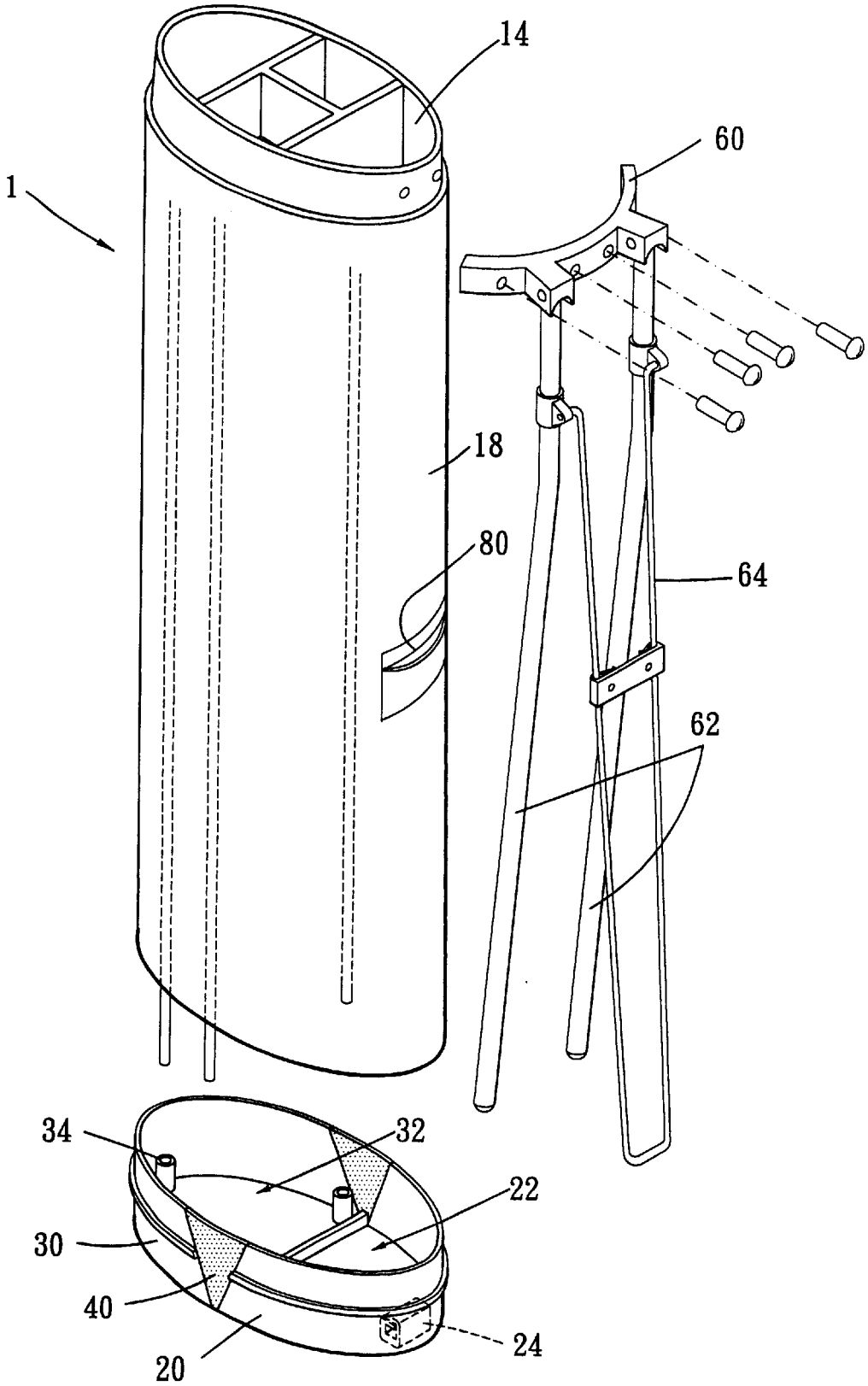
FIG. 6 is a perspective exploded view showing the use of a third embodiment of the present invention.
Figure 7:
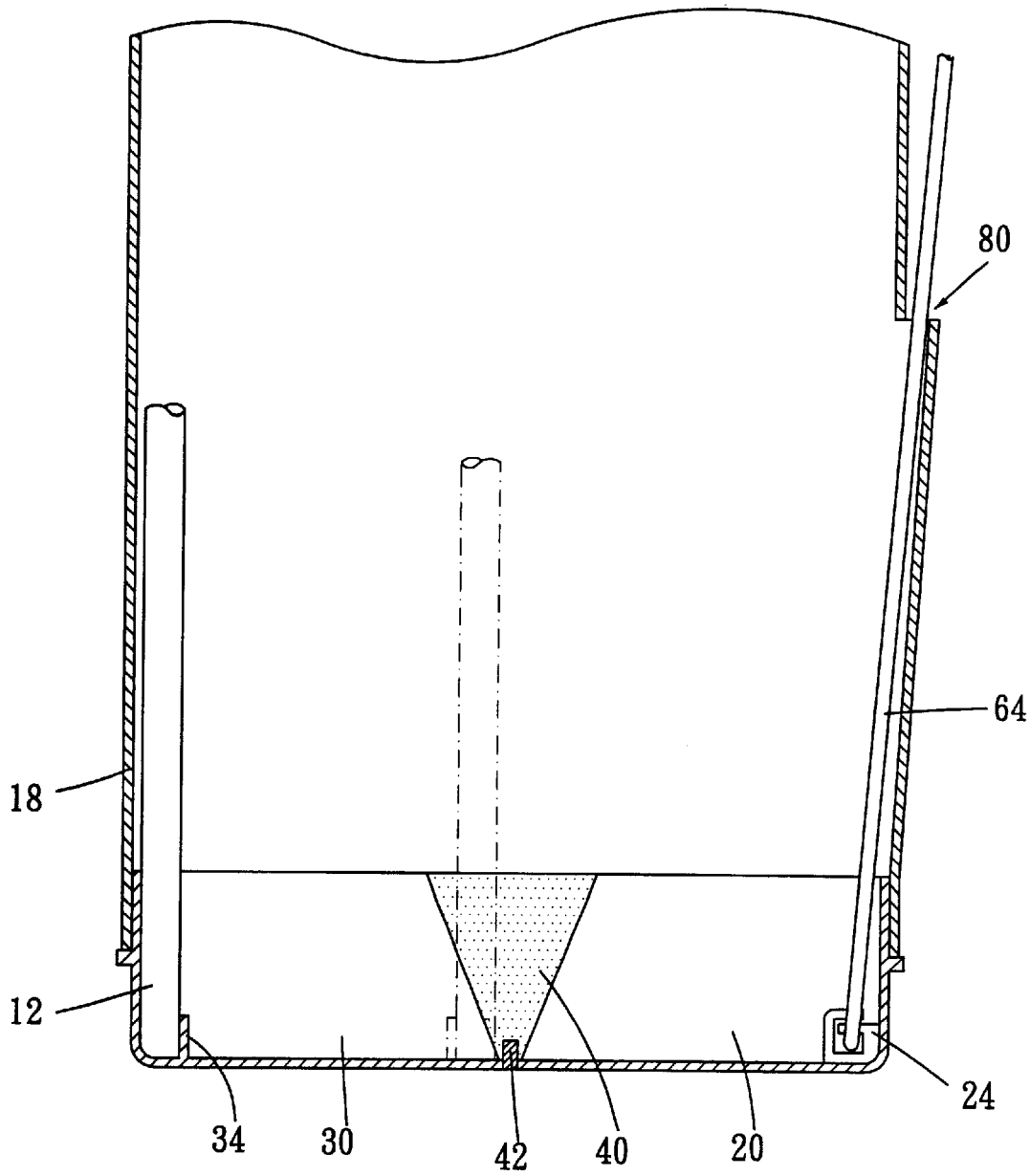
FIG. 7 is a side view showing the use of the third embodiment of the present invention.

Please refer to FIGS. 6 and 7. The connecting member 24 can be alternatively disposed inside the first receiving room 22. A lateral side of the bag body 18 is formed with a slot 80. The lower end of the V-shaped resilient member 64 can be passed through the slot 80 to pivotally connect with the connecting member 24. Therefore, no article will excessively protrude from outer face of the golf bag 1 and the base seat 2 to intervene with the movement of a user around the golf bag 1.

Figure 8:
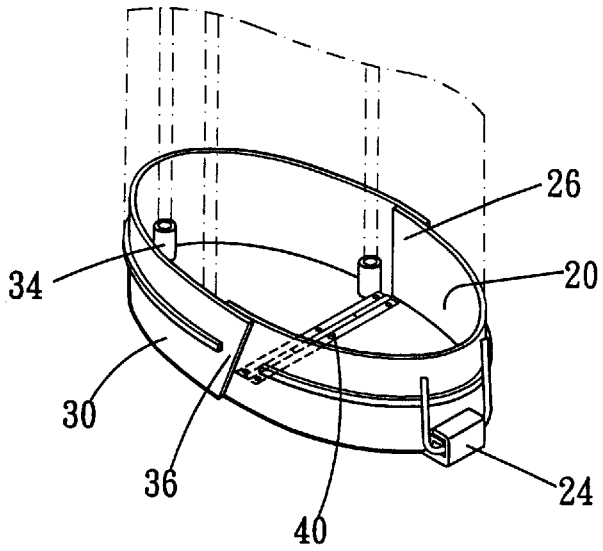
FIG. 8 is a perspective view of a fourth embodiment of the present invention.
Figure 9:
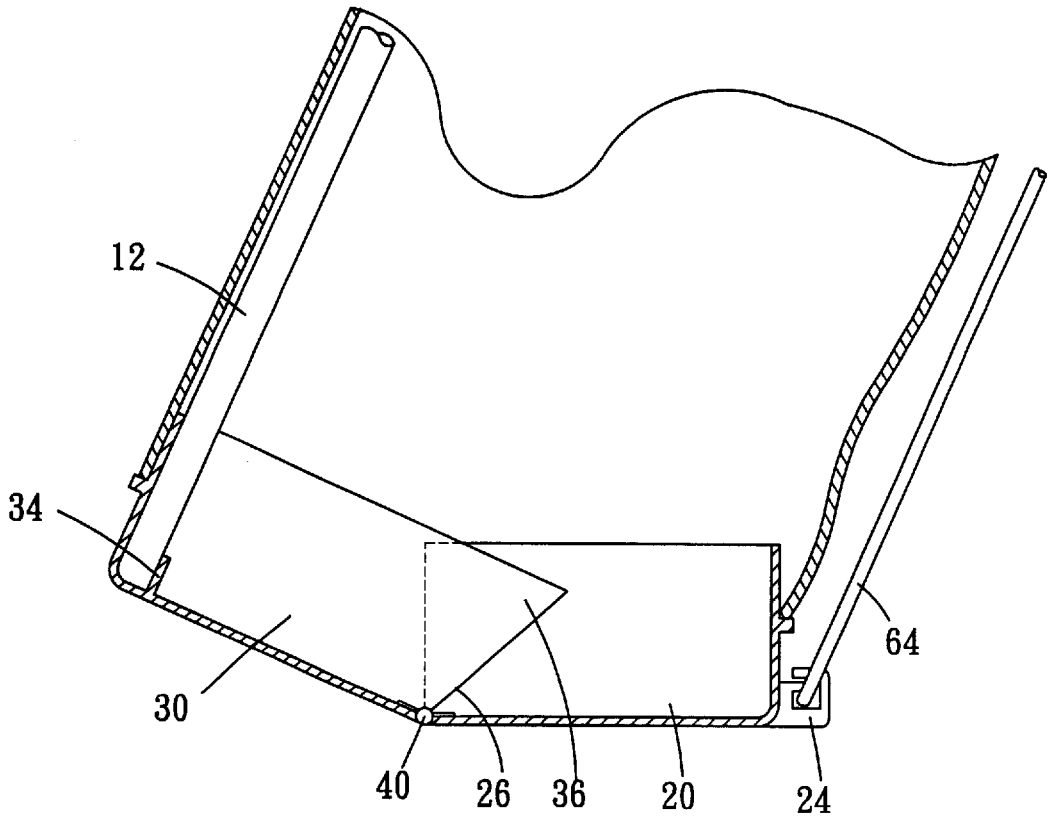
FIG. 9 is a side view of the fourth embodiment of the present invention.

Please refer to FIGS. 8 and 9. The front and rear sections 20, 30 can be connected by an alternative measure. A hinge is bridged between the bottom faces of the front and rear sections 20, 30 instead of the aforesaid pivot section 40 made by injection molding. In addition, the edge portions 26, 36 of the opposite sides of the front and rear sections 20, 30 are partially overlapped on each other so as to avoid torsion or intrusion of mud or sand into the base seat 2.

Figure 10:
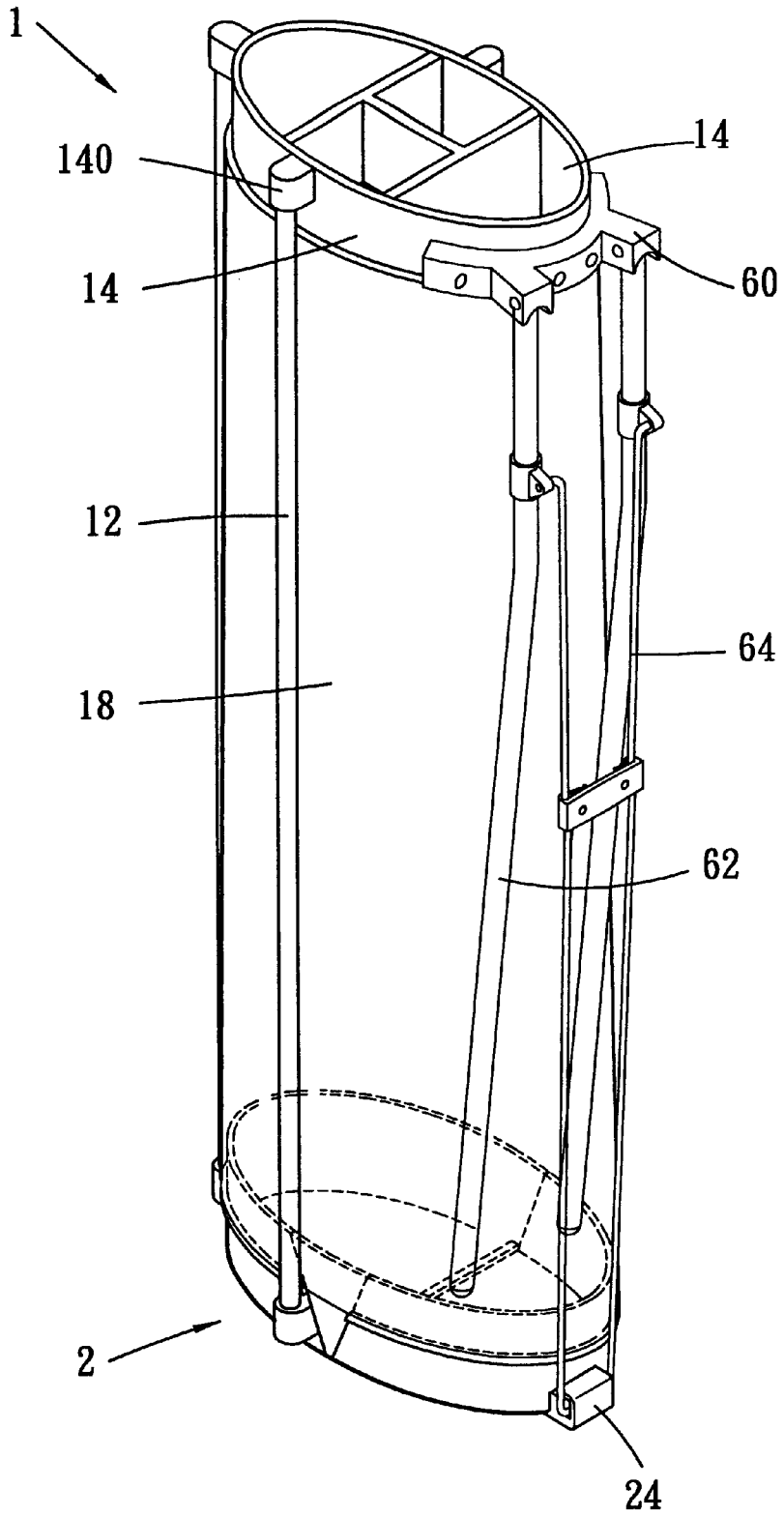
FIG. 10 is a perspective view of a fifth embodiment of the present invention.

FIG. 10 shows still another embodiment of the present invention, in which the first fixing members 34 of the base seat 2 protrude out of the base seat 2 and the second fixing members 140 protrude out of the annular frame 14. Under such circumstance, the support rods 12 are exposed to outer side of the golf bag 1 to facilitate the assembling operation.

In above embodiments, the front and rear sections 20, 30 respectively are halves of the base seat 2 and the pivot section 40 is positioned at the center of the base seat 2. However, in practical application, the front and rear sections 20, 30 can alternatively have different sizes and the capacity of the first receiving room 22 can be smaller than that of the second receiving room 32. Therefore, the rear section 30 can bear the weight of more golf clubs, whereby when the golf bag 1 is positioned in an upright state, the golf bag 1 can stand more stably.

The above embodiments are only used to illustrate the present invention, not intended to limit the scope thereof. Many modifications of the above embodiments can be made without departing from the spirit of the present invention.

What is claimed is:

1. A base seat for a golf bag having a bag body with a pivoting leg set including a resilient member, the base seat comprising:

a) a first section having a first bottom and a first upstanding wall extending from the first bottom;

b) a second section having a second bottom and a second upstanding wall extending from the second bottom, the first and second upstanding walls having adjacent portions forming a V-shaped notch therebetween;

c) a connecting member on the first section adapted to engage the resilient member; and, d) a one-piece, molded, flexible pivot section including bridging portions bridging the V-shaped notches between the first and second upstanding walls, and a rib portion extending between the bridging portions and pivotally connecting the first and second bottoms whereby the first and second sections of the base seat may pivot relative to each other.

2. The base seat of claim 1 wherein the connecting member is located on an exterior of the first section.

3. The base seat of claim 1 wherein the connecting member is located on an interior of the first section.

4. The base seat of claim 1 further comprising a plurality of fixing members on the second section and configured to receive support rods of the bag body.

5. The base seat of claim 4 wherein the plurality of fixing members are located on an interior of the second section.

6. The base seat of claim 4 wherein the plurality of fixing members are located on an exterior of the second section.

* * * * *